United States Patent [19]

O'Grady

[11] Patent Number: 4,620,425

[45] Date of Patent: Nov. 4, 1986

[54] THERMAL PROTECTOR HOUSING

[75] Inventor: Norman J. O'Grady, Louisville, Ky.

[73] Assignee: General Electric Company, Louisville, Ky.

[21] Appl. No.: 764,311

[22] Filed: Aug. 12, 1985

[51] Int. Cl.[4] ..... F25B 49/00

[52] U.S. Cl. ..... 62/230; 62/298; 310/68 C; 361/22; 417/32

[58] Field of Search ..... 62/226, 228.1, 230, 62/298, 77; 417/32, 44, 902; 361/22, 25, 26, 27; 310/68 R, 68 C; 337/327, 380, 398, 414, 415; 236/DIG. 6, DIG. 12

[56] References Cited

U.S. PATENT DOCUMENTS

| | | | |
|---|---|---|---|
| 2,946,203 | 7/1960 | Carver | 62/230 |
| 3,010,401 | 11/1961 | Granquist | 417/32 |
| 3,080,103 | 3/1963 | McAllister | 230/17 |
| 3,209,992 | 10/1965 | Christiansen | 417/902 X |
| 3,233,822 | 2/1966 | Comstock et al. | 230/17 |
| 3,771,321 | 11/1973 | Maksy | 62/298 |
| 4,045,761 | 8/1977 | Peterson | 310/68 C |
| 4,387,412 | 6/1983 | Woods et al. | 361/26 X |

*Primary Examiner*—Harry Tanner

*Attorney, Agent, or Firm*—Frank P. Giacalone; Radford M. Reams

[57] ABSTRACT

In a hermetic compressor there is provided a resilient retainer member adapted to removably secure a thermal overload protector relative to the compressor casing. The overload protector is arranged in a housing which is adapted to engage the upper wall of the casing. The retainer member includes one end portion dimensioned to engage the housing whereby downward pressure on the retainer member secures the overload protector relative to the casing. The overload protector housing is formed to include a pair outwardly projecting leg members. A slot formed on one of the legs aligns with an opening in the other leg are engageable by a tool which is employed to exert an external force on the housing sufficient to allow removal and replacement of the thermal protector housing relative to the retainer member.

11 Claims, 6 Drawing Figures

THERMAL PROTECTOR HOUSING

BACKGROUND OF THE INVENTION

This invention relates to a hermetic motor compressor and more particularly to a retaining system for removably securing the motor overload protector relative to the compressor casing.

It is desirable, in hermetic motor compressors, to provide a thermal protection device which deenergizes the compressor when the temperature within the case approaches the degree which could damage the insulation of the motor windings. In many of the present day refrigerant compressors the thermal protectors are mounted within the sealed hermetic case. While this arrangement is effective in sensing motor temperatures, it, however, causes some problems when the protector itself malfunctions. This results in the entire compressor being discarded since in most instances it is not practical to disassemble a hermetic compressor assembly to repair its internal parts. One solution to this problem is to mount the thermal protection device externally. In this instance a mechanical fastening means must be provided which insures that the thermal protection device remain in intimate contact with the compressor casing while at the same time ensure its convenient replacement when necessary.

Generally compressors as employed in household refrigeration are contained in a rather restrictive machine compartment. In order to ensure that the maximum amount of cabinet space is alloted to the interior or refrigerated portion of the cabinet, the machine compartment is configured to take up a minimum amount of cabinet space. Generally the compressor and the high side portion of the refrigerant system are located in the machine cabinet together with other components such as condensate removal systems and electrical components.

This arrangement while accomplishing its goal of providing that maximum space is allocated to the interior of the cabinet also results in the machine compartment being relatively crowded with refrigeration system components. Removal of the individual components of refrigerator system such as the thermal overload compressor motor protector from the machine compartment can be time consuming and somewhat difficult due in part to the crowded condition of the machine compartment. This is especially true since the components such as the compressor which are part of a closed refrigerant system are all connected through refrigerant carrying conduits and accordingly cannot be readily removed from the machine compartment for servicing or replacement of individual components associated therewith.

Accordingly by the present invention means are provided for replacing the thermal protecter without removing the compressor from its position in the machine compartment.

SUMMARY OF THE INVENTION

By the present invention there is provided a hermetic compressor including a casing having a top wall provided with a vertically extending stud member. Positioned on the top wall of the casing there is a thermal overload protector which is arranged in a housing. The housing includes a side wall, a top wall, and a base wall dimensioned to conform to the casing upper wall. A pair of leg members project outwardly from the side wall at a location adjacent the base wall. One of the legs is provided with a slot which is aligned with an opening in the other leg member. The slot and opening are dimensioned to be engagable by a tool.

A retainer removably secures the thermal overload protector housing to the compressor top wall with the base wall of housing juxtapositioned the casing top wall.

The retainer is formed of an elongated, stiffly flexible metal stock and includes an opening intermediate its ends dimensioned for receiving the stud member. One end portion of the retainer being adopted to engage the top wall and the leg members of the housing.

The stud member is engaged by a holding member dimensioned for applying pressure on the retainer to cause the end portion of the retainer to forcibly engage the thermal overload protector housing to thereby hold the base wall of the housing against the casing top wall, whereby an external force exerted by the tool while it is positioned in the slot and opening of the leg members allows removal of the thermal overload protector housing from between the end portion of the retainer and the compressor casing top wall.

DESCRIPTION OF THE PREFERRED EMBODIMENT

Figure 1:
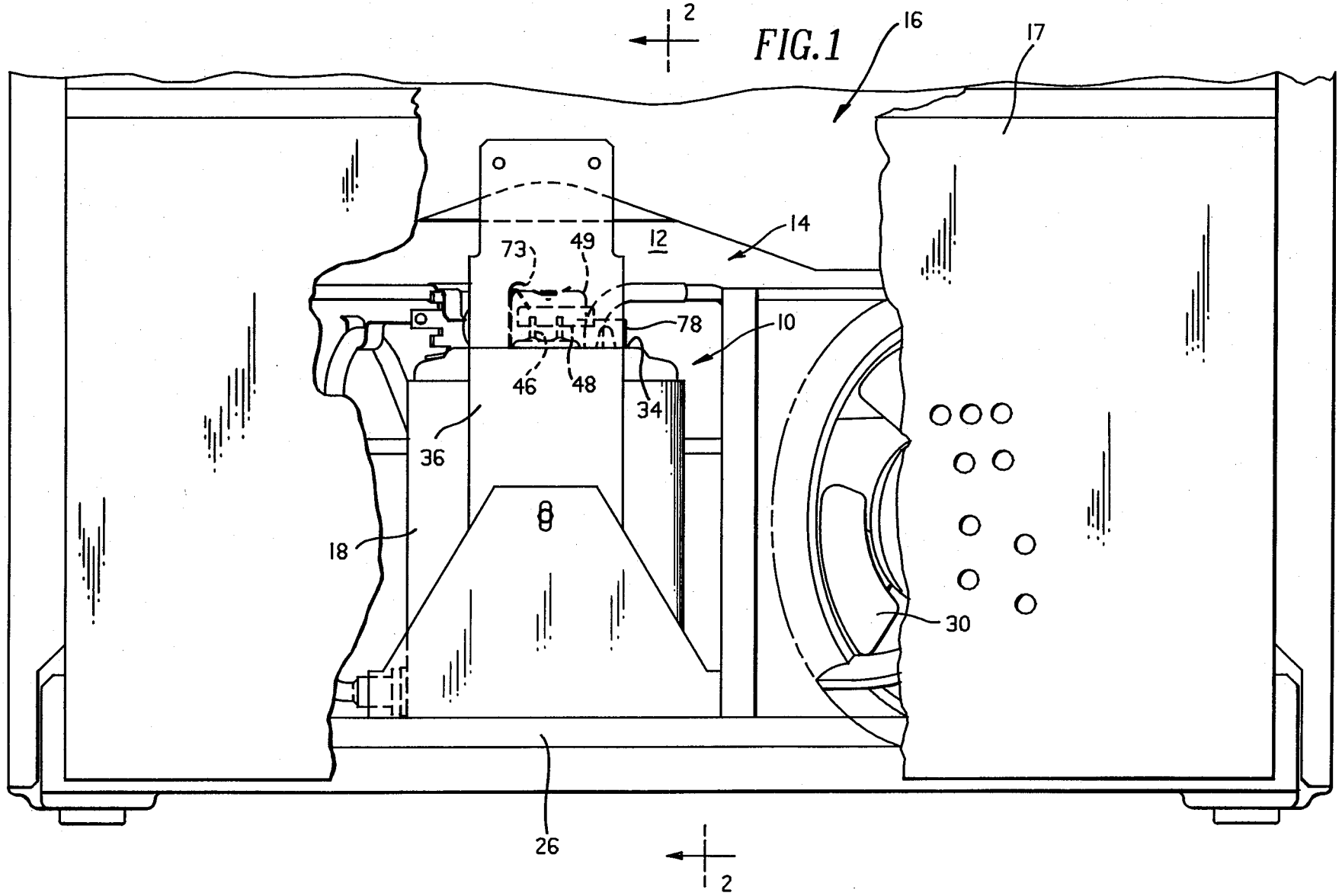
FIG. 1 is a rear elevational view of a refrigerator machine compartment incorporating the present invention.

Referring now to the drawings, wherein a preferred embodiment of the invention has been shown and particularly to FIG. 1, the basic components of the refrigerant hermetic motor compressor assembly 10 is shown arranged in a machinery compartment 12 of a household refrigerator. Access to the machine compartment 12 is through an opening 14 in the back wall of the refrigerator cabinet 16. Generally a panel 17 is arranged over the opening 14. In order to ensure that maximum space is assigned to the interior of the cabinet, the machine compartment is designed to occupy a minimum amount of cabinet volume. Due to number of refrigerant system components that are connected to or associated with the compressor together with other components that are conveniently placed there, the machine compartment can become overly crowded.

Figure 2:
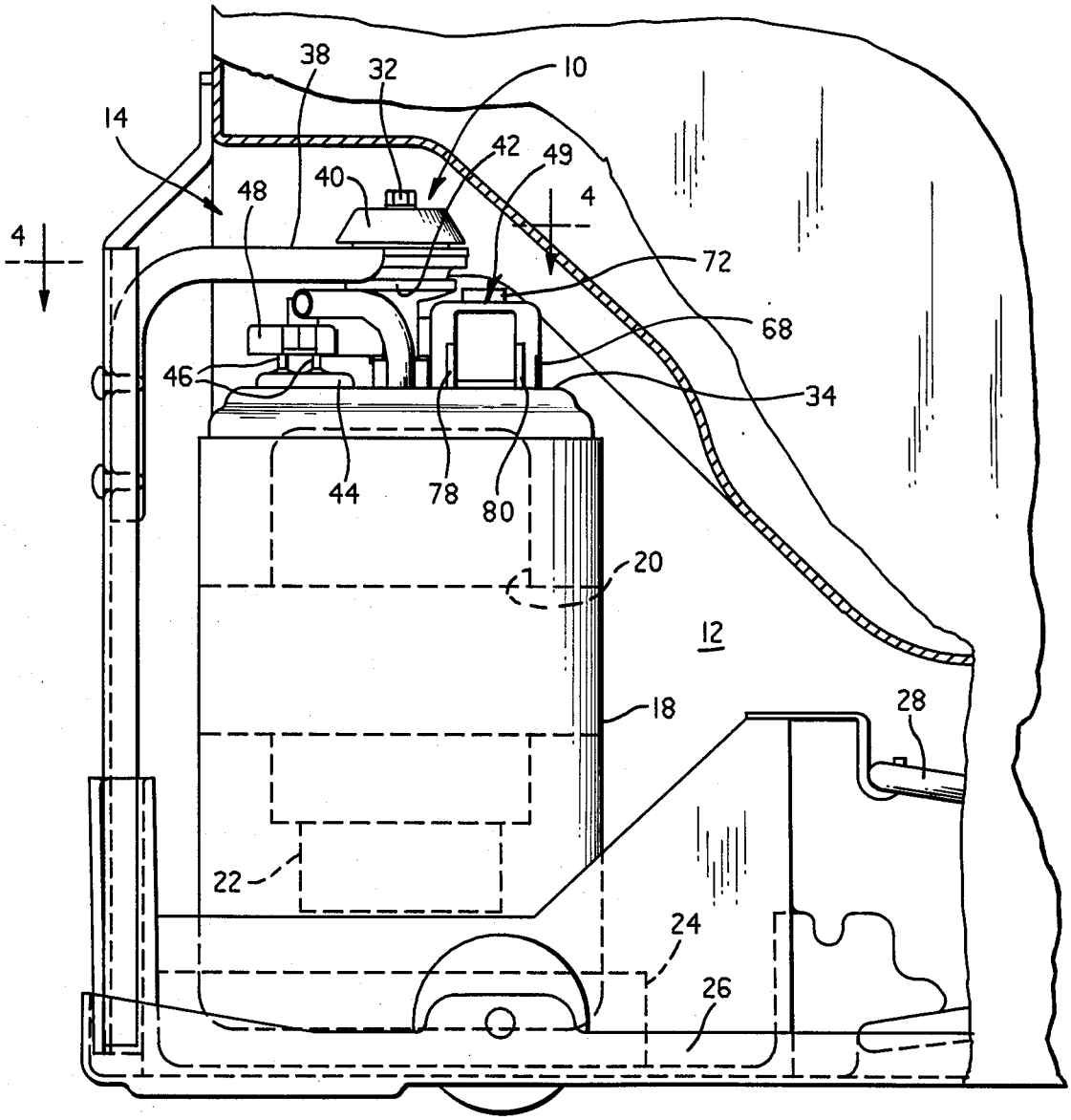
FIG. 2 is an elevational view of a hermetic motor compressor taken along line 2—2 of FIG. 1.

The assembly 10 is of conventional construction and include an outer casing 18 housing a motor compressor unit comprising an upper motor section 20 and a lower compressor section 22. As shown in FIGS. 1 and 2 the compressor casing 18 is mounted in its vertical position. The casing 18 of the compressor is arranged with its lower portion located in a resilient mounting member 24 which is positioned on the support or base wall 26. The support 26 (FIG. 2) including the compressor assembly and the high side components of the refrigerator system such as the condensor 28 and fan 30 assembly for moving air through the compartment 12 is inserted as a unit into the machine compartment 12 through the opening 14. To insure the vertical stability of the compressor casing 18 means are provided to support the casing at its upper end. To this end the compressor is provided with a stud 32 extending upwardly from and secured to the upper wall 34 of the compressor casing 18. A support structure is provided which includes a post 36 supported on the base 26 in a vertical position. A cantilevered arm 38 extends perpendicular to the vertical post 36 to a position where it overlies the compressor and more particularly the stud 32. Located on the arm 38 (FIG. 2) is a resilient grommet 40 dimensioned to seat in a member 42 which is secured to the stud 32. With the compressor in its installed or operating position the stud 32 is arranged so as to extend through the grommet 40 to thereby stabilize the vertical axis of the compressor.

In order to electrically connect the motor 20 to an electrical power source there is provided a connector 44 (FIG. 2) mounted directly to the top wall 34 of the casing 18. The terminal connector 44 is provided with a plurality of conductor pins 46. Conductor pins 46 receive a terminal or receptacle block assembly 48 which includes female connector (not shown) adapted to be plugged into engagement with the conductor pins 46.

Figure 4:
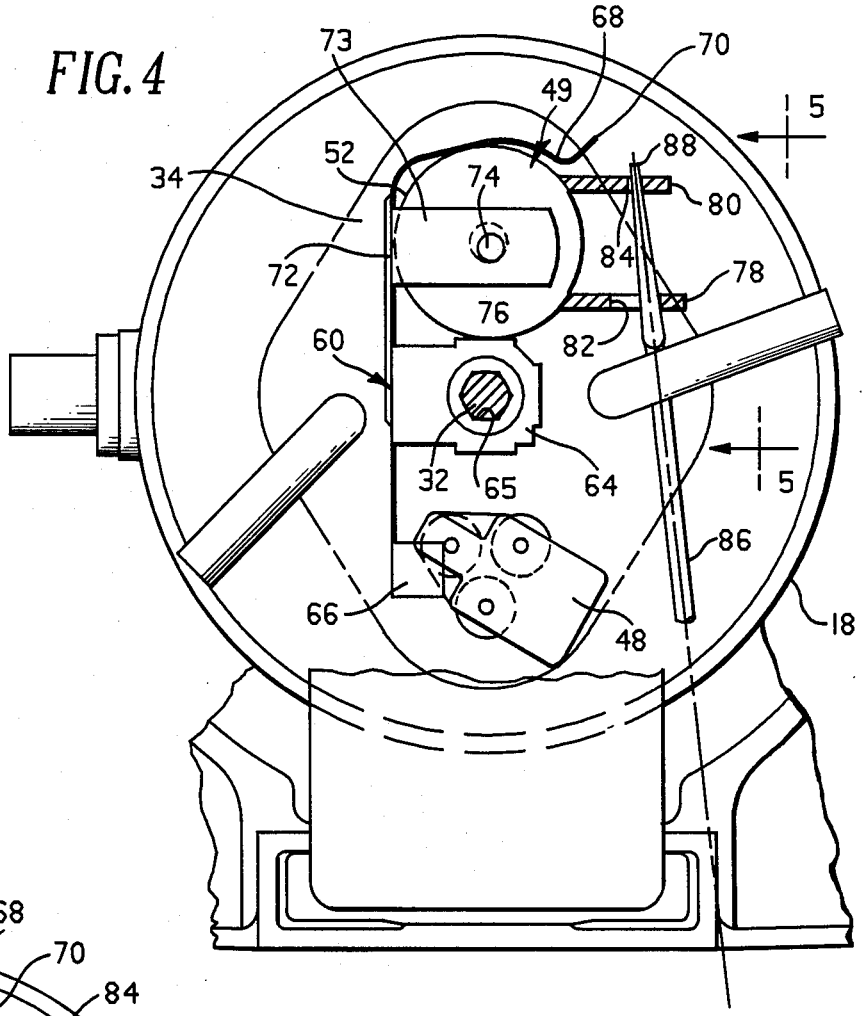
FIG. 4 is a plan view taken along line 4—4 of FIG. 2.
Figure 5:
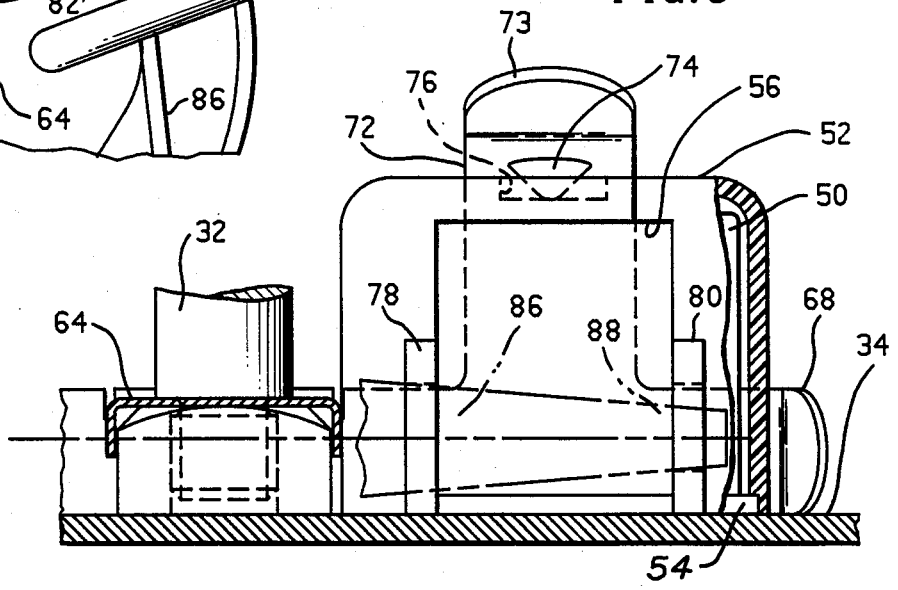
FIG. 5 is an elevational view taken along line 5—5 of FIG. 4.

In order to provide thermal protection for the motor 20 within the casing 18 there is provided a thermal overload protection assembly 49 including an inverted inner cup-shaped member 50 (FIG. 5) in which a thermal responsive switch (not shown) is arranged and an outer housing 52. This thermal protector 50 may be of any well-known type which is adapted to open a switch upon sensing a predetermined high temperature. The lower circumferentially disposed edge portion 54 of member 50 is in a substantially flat plane which serves to maintain it in intimate contact with a flat portion of the upper wall 34 of the casing. As shown best in FIG. 4 when the lower edge portion 54 of member 50 is positioned on flat wall portion 34 the thermal responsive switch is in effect positioned in a pocket formed by outer housing 52 containing air which is exposed directly to the temperature of the wall 34. It is important therefore that the edge portion 54 remain in intimate contact with wall portion 34 since ambient air entering the pocket will affect the temperature sensed by the thermal switch. The outer inverted cup-shaped housing 52 of protector assembly 48 substantially surrounds the side and top walls of the inner member 50. The housing 52 as shown in FIG. 5 is provided with an opening 56 through which electrical connection is made to the thermal switch and a top wall 54. A downward force on cover 52 will ensure intimate contact between housing 52 and the wall portion 34.

A retaining member 60 (FIG. 4) is provided for removably securing the thermal overload protector assembly 49 relative to the surface 34 and receptacle block 48 relative to the conductor pins 46 of the connector 44 respectively as they are arranged on the compressor casing. The retaining member 60 is held relative to the compressor by the compressor mounting stud 32 as an integral part. The retainer member 60 made of relatively stiff resilient material that yieldably holds the connector 48 and housing 52 against the casing surface 34. In its position on the post 32 the retainer member 60 is adapted to securely engage both the thermal protector 52 and receptacle block asembly 48 as will now be fully described.

The retainer member 60 is formed from a single piece of spring steel including a body member 62. Extending from the central area of body member 62 is a horizontally positioned central locating portion 64 which includes an opening 65 for receiving the post 32. Formed on one end portion of the member 60 is a terminal block holding member 66. With the member 60 secured to the post 32 the holding member 66 engages the upper wall of the receptacle block assembly 48.

Figure 3:
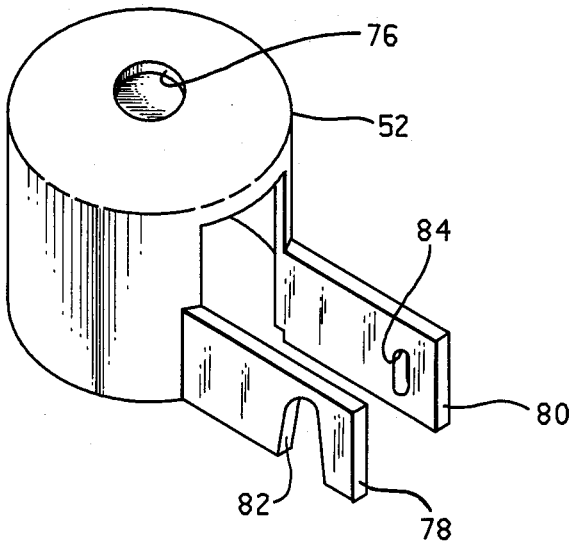
FIG. 3 is a perspective view showing details of the thermal protector housing incorporating the present invention.

The other end portion of the member 60 includes a portion 68 (FIGS. 4 and 5) extending substantially perpendicular to the body portion 62 including an inwardly extending end portion which is dimensioned to engage the side walls of the thermal protector housing member 52, as shown in FIG. 3.

Formed adjacent the end portion 68 of member 60 is vertically extending thermal protector holding member 72 which has formed at its upper end an arcuate horizontally extending portion 73. The arcuate portion is dimensioned so that when member 60 is secured to the post 32 as described above the arcuate portion 73 is biased downwardly against the upper wall of the thermal protector cover member 52 to insure engagement against wall 34. The central portion of arcuate portion is provided with a downwardly projecting dimple 74 which is dimensioned to engage a depression 76 or opening in the upper wall of housing 52. This arrangement serves to locate the housing 52 relative to the member 60 and give axial stability to the thermal protector.

While an arrangement has been provided for securely holding the terminal block assembly and motor protector relative to the compressor casing 12 it should be noted that due to the flexibility of the retainer member 60, it is possible in this present arrangement to remove the thermal protector assembly 49 and terminal receptacle block assembly 48 without disassembling or removing the retainer member 60 from the stud 32. Further, it should be noted that the retainer member 60 may be installed on the stud 32 as described above prior to the installation of the receptacle block assembly 48 on conductor pins 46 and also prior to positioning the protector assembly 49 on the wall portion 34. This allows removal and placement of these components in their installed positions without the use of special tools or other devices since the member 60 is yieldable under normal hand pressure by an installer. However, due to the compressor placement in the machine compartment and the location of other refrigerant system related components access to the thermal protector housing 52 as shown in FIG. 1 and is severely restricted. While as mentioned above it does, in fact, require little force to remove the thermal protector housing 52 from its location on the compressor, its position in the machine compartment relative to the high side components precludes a servicer from getting a hand in the compartment 14 in a position to manually remove it.

By the present invention means are provided for facilitating the removal of the thermal protector and more specifically the housing 52 from its secured position described above. To this end as shown in FIGS. 3, 4 and 5 the housing 52 is formed with a pair of projecting leg members 78 and 80. The legs 78 and 80 extend outwardly a distance sufficient to be visable when the compressor assembly is viewed from the rear as shown in FIG. 1. The leg 78 is provided with a slot 82 while the leg 80 is provided with an opening 84 which is substantially aligned with slot 82 as viewed in FIGS. 3–5.

Figure 6:
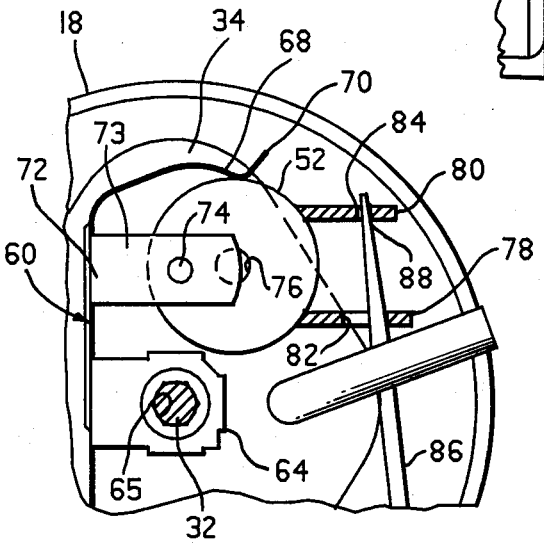
FIG. 6 is a fragmentary plan view showing the thermal protector housing being removed.

To remove the thermal protector without pulling the compressor assembly from the machinery compartment a servicer as shown in FIGS. 4 and 5 merely inserts a tool 86 such as a screwdriver through the opening 14 to the machine compartment so that it passes through slot 82 while placing the end portion 88 of tool 86 into the opening 84. At this point exerting a lateral force on tool 86 will, as shown in FIG. 6 cause the retainer portion 68 and 73 to yield sufficiently to allow removal of the housing 52 from its position between the retainer 62 and wall 34. At this time the housing 52 including the thermal protector 50 is carried by the tool 86 and removed through opening 14 from the machine compartment 12. The servicer can replace the thermal protector 50 and, reinstall the housing 52 containing the replacement thermal protector in its design position beneath the retainer by placing the tool 86 in the slot 82 and opening 84 as explained above in the process of removing the housing 52.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A hermetic compressor including a casing having a top wall;

a thermal overload protector arranged in a housing including a side wall, a top wall, and a lower edge portion dimensioned to conform to said casing top wall, a pair of leg members projecting outwardly from said side wall having a slot on one of said leg members aligned with an opening in the other one of said leg members dimensioned to be engagable by a tool;

a retainer mounted on said casing dimensioned for removably securing said thermal overload protector housing to said compressor top wall with said lower edge portion juxtapositioned said casing top wall whereby an external force exerted by said tool positioned in said slot and opening in said leg members will allow removal of said thermal overload protection housing from between said retainer and said compressor casing top wall.

2. A hermetic compressor including a casing having a top wall provided with a vertically extending stud member;

a thermal overload protector arranged in a housing including a side wall, a top wall, and a lower edge portion dimensioned to conform to said casing top wall, a pair of leg members projecting outwardly from said side wall having a slot on one of said leg members aligned with an opening in the other one of said leg members dimensioned to be engagable by a tool;

a retainer for removably securing said thermal overload protector housing to said compressor formed of an elongated, stiffly flexible metal stock and includes an opening intermediate its ends dimensioned for receiving said stud member, one end portion of said retainer being dimensioned to engage said top wall of said housing to thereby hold said lower edge portion of said housing against said casing top wall whereby an external force exerted by said tool positioned in said slot and opening in said leg members will allow removal of said thermal overload protection housing from between said one end portion of said retainer and said compressor casing top wall.

3. The hermetic compressor according to claim 2 wherein said pair of leg members are arranged in spaced parallel relationship.

4. The hermetic compressor according to claim 3 wherein said pair of leg members having the lower edge in the same plane as said lower edge portion of said housing.

5. The hermetic compressor according to claim 4 wherein said housing is substantially an inverted cup-shaped member providing an internal chamber for housing said thermal overload protector and said lower edge portion being the distal end of said side wall.

6. The hermetic compressor according to claim 5 wherein said housing side wall includes an opening between said leg member for allowing electrical connection to said thermal overload protector.

7. A refrigerator cabinet including an opening therein providing access to a machine compartment, a hermetic compressor arranged in said machine compartment including a casing having a top wall provided with a vertically extending stud member;

a thermal overload protector arranged in a housing including a side wall, a top wall, and a lower edge portion dimensioned to conform to said casing top wall, a pair of leg members projecting outwardly from said side wall having a slot on one of said leg members aligned with an opening in the other one of said leg members dimensioned to be engagable by a tool inserted through said opening in said cabinet;

a retainer for removably securing said thermal overload protector housing to said compressor;

said retainer formed of an elongated, stiffly flexible metal stock and includes an opening intermediate its ends dimensioned for receiving said stud member, one end portion of said retainer being dimensioned to engage said top wall of said housing to thereby hold said lower edge portion of said housing against said casing top wall with said lower edge portion juxtapositioned said casing top wall whereby an external force exerted by said tool positioned in said slot and opening in said leg members will allow removal of said thermal overload protection housing from between said retainer and said compressor casing top wall, and carried by said tool through said opening in said cabinet.

8. The hermetic compressor according to claim 7 wherein said pair of leg members are arranged in spaced parallel relationship.

9. The hermetic compressor according to claim 8 wherein said pair of leg members having the lower edge in the same plane as said lower edge portion of said housing.

10. The hermetic compressor according to claim 9 wherein said housing is substantially an inverted cup-shaped member providing an internal chamber for housing said thermal overload protector and said lower edge portion being the distal end of said side wall.

11. The hermetic compressor according to claim 10 wherein said housing side wall includes an opening between said leg member for allowing electrical connection to said thermal overload protector.

* * * * *